US010646770B2

(12) United States Patent
Ritter

(10) Patent No.: US 10,646,770 B2
(45) Date of Patent: May 12, 2020

(54) THREE DEGREES OF FREEDOM MOUNTING SYSTEM FOR SNOWBOARDS AND SPLITBOARDS

(71) Applicant: Spark R&D IP Holdings, LLC, Bozeman, MT (US)

(72) Inventor: William J. Ritter, Bozeman, MT (US)

(73) Assignee: Spark R&DIP Holdings, LLC, Bozeman, MT (US)

( * ) Notice: Subject to any disclaimer, the term of this patent is extended or adjusted under 35 U.S.C. 154(b) by 0 days.

(21) Appl. No.: 16/235,011

(22) Filed: Dec. 28, 2018

(65) Prior Publication Data

US 2019/0224561 A1 Jul. 25, 2019

Related U.S. Application Data

(60) Provisional application No. 62/621,757, filed on Jan. 25, 2018.

(51) Int. Cl.

| | |
|---|---|
| ***A63C 10/18*** | (2012.01) |
| ***A63C 9/00*** | (2012.01) |
| ***A63C 10/20*** | (2012.01) |

(52) U.S. Cl.

CPC ..... *A63C 10/18* (2013.01); *A63C 9/00* (2013.01); *A63C 10/20* (2013.01)

(58) Field of Classification Search

CPC combination set(s) only.

See application file for complete search history.

(56) References Cited

U.S. PATENT DOCUMENTS

| | | | | |
|---|---|---|---|---|
| 5,049,079 | A | 9/1991 | Furtado et al. | |
| 5,156,644 | A * | 10/1992 | Koehler | A63C 7/1066 24/442 |
| 5,984,324 | A | 11/1999 | Wariakois | |
| 6,189,899 | B1 * | 2/2001 | Carlson | A63C 5/128 280/14.22 |

(Continued)

FOREIGN PATENT DOCUMENTS

| | | |
|---|---|---|
| CN | 203329325 U | 12/2013 |
| CN | 203329326 U | 12/2013 |

(Continued)

*Primary Examiner* — Brian L Swenson

(74) *Attorney, Agent, or Firm* — Stone Creek Services LLC; Alan M Flum

(57) ABSTRACT

A mounting device for snowboards and other snow glide boards that includes a puck assembly. The adjustment system can be adjusted with three degrees of freedom with respect to the snowboard: foot placement, foot angle, and heel and toe centering. The puck assembly can attach directly to the snowboard or can be built into the snowboard boot binding. The mounting device can include a slider block/snowboard binding base plate and a disk. The disk includes a series of projections. The slider block/snowboard binding base plate receives the disk in a recess indented in the slider block/snowboard binding base plate top surface. The recess is patterned with a series of detents sized and shaped to receive the projections from the disk. The detents arranged as a series of arcs, of equal radius, translated linearly on even increments. This combination allows for the foot angle and heel and toe centering adjustments to be made concurrently.

20 Claims, 11 Drawing Sheets

(56) References Cited

U.S. PATENT DOCUMENTS

| | | | | |
|---|---|---|---|---|
| 6,523,851 | B1 * | 2/2003 | Maravetz | A63C 5/02 280/14.22 |
| 7,204,496 | B2 | 4/2007 | Rawcliffe | |
| 7,823,905 | B2 | 11/2010 | Ritter | |
| 8,276,921 | B2 | 10/2012 | Walker | |
| 8,469,372 | B2 | 6/2013 | Kloster et al. | |
| 8,708,371 | B2 | 4/2014 | Balun | |
| 9,452,344 | B2 * | 9/2016 | Ritter | A63C 5/031 |
| 9,795,861 | B1 | 10/2017 | Kloster et al. | |
| 9,827,481 | B2 | 11/2017 | Ritter | |
| 9,884,243 | B2 | 2/2018 | Wariakois | |
| 10,035,058 | B1 | 7/2018 | Ritter | |
| 2002/0140208 | A1 * | 10/2002 | Duvall | A63C 10/14 280/624 |
| 2004/0207166 | A1 * | 10/2004 | Elkington | A63C 10/14 280/14.24 |
| 2006/0091622 | A1 * | 5/2006 | Sabol | A63C 10/14 280/14.24 |
| 2011/0057420 | A1 * | 3/2011 | Walker | A63C 9/0802 280/624 |
| 2013/0200594 | A1 * | 8/2013 | Watson | A63C 10/18 280/618 |
| 2015/0343297 | A1 | 12/2015 | Ekberg | |
| 2019/0038958 | A1 * | 2/2019 | Smith | A63C 10/14 |
| 2019/0224561 | A1 * | 7/2019 | Ritter | A63C 10/18 |

FOREIGN PATENT DOCUMENTS

| | | | |
|---|---|---|---|
| CN | 105107186 | A | 12/2015 |
| JP | 10216297 | A | 8/1998 |
| JP | 11253602 | A | 9/1999 |

* cited by examiner

THREE DEGREES OF FREEDOM MOUNTING SYSTEM FOR SNOWBOARDS AND SPLITBOARDS

CROSS-REFERENCE TO RELATED APPLICATIONS

This application claims the benefit of U.S. Provisional Application No. 62/621,757, filed on Jan. 25, 2018. The entire contents of U.S. Provisional Application No. 62/621,757 are hereby incorporated by reference.

BACKGROUND

This disclosure relates to devices for adjusting the position of boot binding on snowboards.

Snowboarding is a recreational activity where a rider glides down a snow-covered mountain, hill, or slope while standing with their feet attached to a single snow glide board known as a snowboard. The concept is like snow skiing except both feet are attached to a single board.

Snowboard riders or "snowboarders" fasten their boots to boot bindings that secure their boots to the snowboard. Unlike skiing, the snowboarder typically positions their feet obliquely, or slantwise, across the board rather than straight ahead. The snowboarder's stance can affect their performance. The ideal stance for each snowboarder is personal. The stance can be determined by three parameters for each foot: foot placement along the length of the board, foot angle, and heel and toe centering. Foot angle is the angle between the centerline of the boot bindings and the lateral centerline of the snowboard. A foot is centered when approximately the same amount of the toe end and the heel end of the boot hang over the edges of the snowboard.

Snowboard bindings can have rotatable disks with slots that adjust the foot placement and foot angle. Some snowboard bindings have slidable heelcups to adjust heel and toe centering. For course adjustment of foot placement, each snowboard binding is aligned over inserts in the snowboard.

SUMMARY

The inventor develops components for snowboards and splitboards. A splitboard is a snowboard separable into re-joinable skis. Splitboard riders separate the splitboard skis to ascend snow-covered slopes. This is known as touring. To ride the splitboard downhill, they rejoin the splitboard skis and use the splitboard as they would a snowboard. Because the splitboard is separable, it uses a different mounting system than standard snowboards. Splitboard bindings and mounting hardware are often constructed differently than snowboard bindings and mounting hardware. For example, splitboard bindings may have touring specific features not found on snowboard bindings. In riding mode, the splitboard boot bindings often slide onto a puck assembly or mounting device that can adjust foot placement, foot angle, and toe centering.

The inventor observed that it may be desirable for a splitboard rider to mount splitboard bindings onto a snowboard. The inventor developed a snowboard mounted puck assembly adapted to receive splitboard bindings. The puck assembly includes a novel adjustment system. The system is adjustable with three degrees of freedom. The puck assembly includes a puck or slider block and a disk. The slider block includes a recess in its top surface for receiving the disk. The disk includes a series of projections. The projections can be spaced along a circular arc concentric with the center of the disk. The recess is patterned with detents sized and shaped to receive the projections from the disk. The detents can be aligned in a series of arcs that are spaced linearly along the length of the slider block. This allows the disk to be adjusted with both an angle and lengthwise offset compared to the slider block. Additionally, the inventor realized that a snowboard binding could be designed with the same recess as the slider block and use the same disc to allow for the three degree of freedom adjustment of a snowboard binding that does not require a separate structure for heel and toe centering.

The disk is secured to the snowboard by threaded fasteners. The threaded fasteners project through slots in the disk and through an aperture in the slider block or snowboard binding base plate. The aperture in the slider block or snowboard binding base plate is large enough to pass through the body of the threaded fastener no matter where it is positioned about the slots in the disk.

The inventor envisions that the novel arrangement of projections and detents can also be applied to a splitboard puck assembly. Each splitboard puck assembly can include pair of splitboard puck subassemblies. Each subassembly includes a disk and a splitboard puck. The novel arrangement of projections can be applied to the disk and the novel arrangement of detents can be applied to the splitboard puck similarly as described above.

This Summary introduces a selection of concepts in simplified form described in the Description. The Summary is not intended to identify essential features or limit the claims.

DRAWINGS

DESCRIPTION

The terms "top, "bottom," "upper," "front," and "back," are relative terms used throughout to help the reader understand the figures. Unless otherwise indicated, these do not denote absolute direction or orientation and do not imply a preference. When describing the figures, the terms "top," "bottom," "front," "rear," are from the perspective of how a typical snowboard rider would view the snowboard or components while standing on the snowboard. Specific dimensions should help the reader understand the scale and advantage of the disclosed material. Dimensions given are typical and the claimed invention is not limited to the recited dimensions. The figures are not necessarily to scale.

Certain features or components and some details of conventional elements may not be shown in the interest of clarity, explanation, and conciseness. For example, some hardware or parts normally associated with snowboards may be omitted for clarity. For example, throughout this disclosure, the slider block can be a snowboard binding base plate (i.e., instead of a splitboard binding, in combination with a separate slider block, the slider block becomes the snowboard binding baseplate that is built into the snowboard binding boot. In that context, the snowboard binding base plate is shown without the rest of the snowboard boot binding. Whenever a binding is illustrated or described, the binding can be a splitboard binding with a slider block or a snowboard binding with a baseplate where the base plate is exploded away for clarity.

Referring to similarly named part with an ordinal prefix such as first, second, or third helps distinguish the parts from one another when referred to together. This implies no preference of one part over the other. Similarly, referring to examples using prefixes such as "first," "second," "third," or "alternative," infers no preference of one example over the other.

Figure 1:
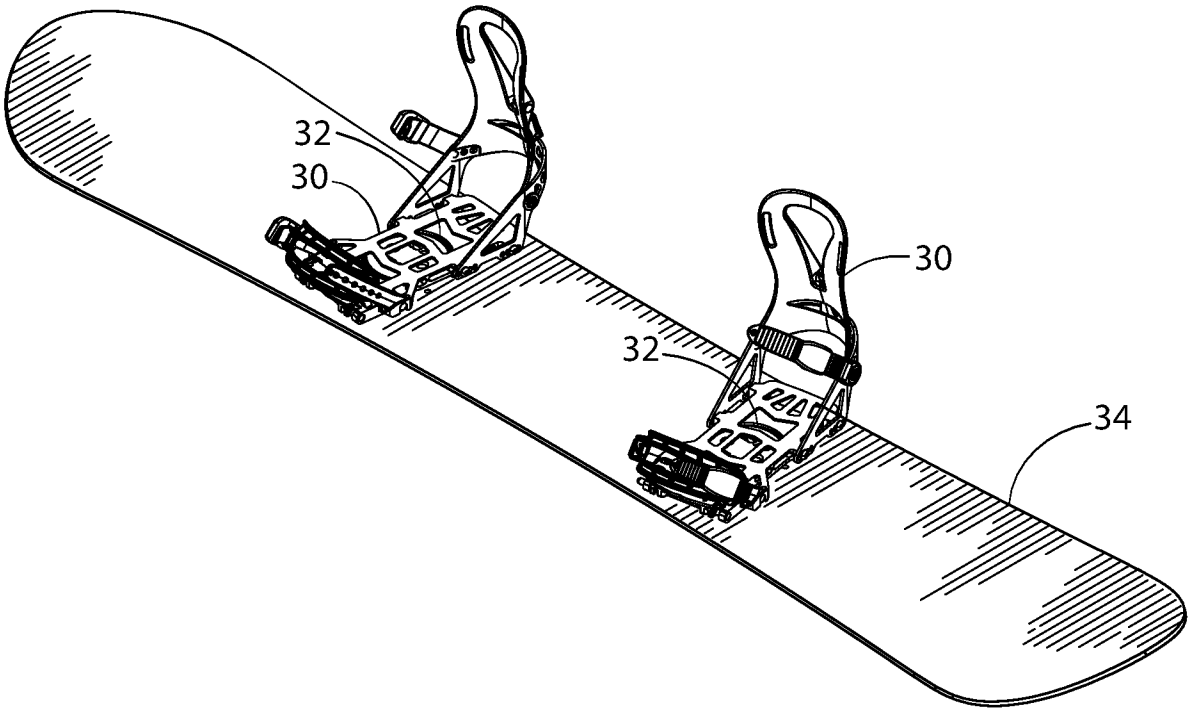
FIG. 1 illustrates, in top perspective view, splitboard boot bindings and a puck assembly attached to a snowboard.
Figure 2:
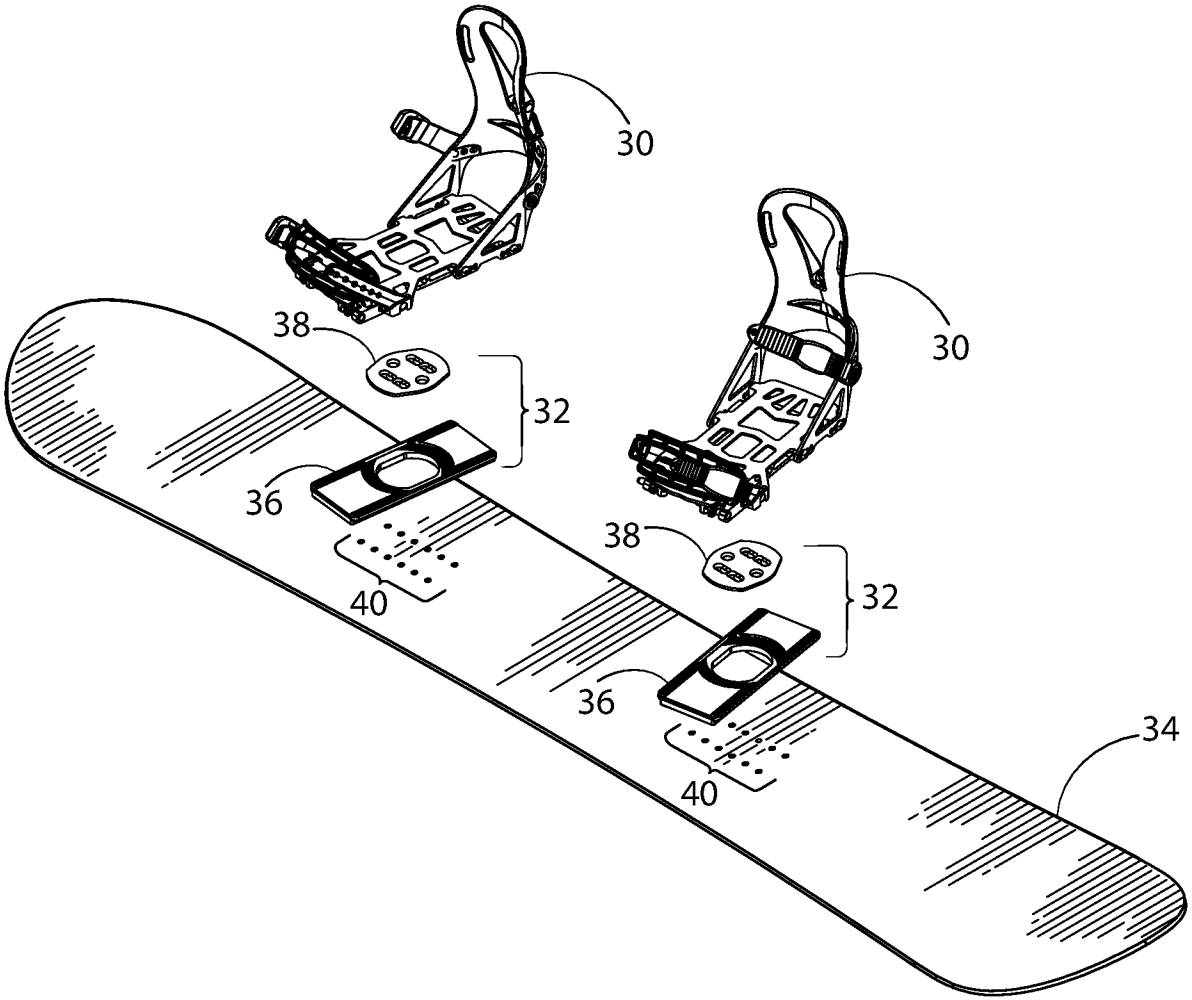
FIG. 2 illustrates, a top perspective view, the splitboard bindings and puck assembly of FIG. 1 exploded to better illustrate the individual components.

The Description refers to figures, where like numerals refer to like elements throughout the several views. FIG. 1 illustrates, in top perspective view, splitboard boot bindings 30 (or snowboard boot bindings with the base plate exploded away) and a puck assembly 32 attached to a snowboard 34 or alternatively, snowboard boot bindings with the base plate puck assembly exploded away for clarity. FIG. 2 illustrates, a top perspective view, the splitboard boot bindings 30 (or snowboard boot bindings with the baseplate exploded away) and puck assembly 32 (or base plate puck assembly) of FIG. 1 exploded away from the snowboard 34 to better illustrate the individual components. The puck assembly 32 includes a slider block/snowboard binding base plate 36 or puck, and a disk 38. The snowboard 34 includes hole patterns 40 for mounting snowboard bindings. These can mount the puck assembly 32. The hole patterns 40 illustrated are an industry standard "4×2" hole pattern. The disk 38, that will be later described in detail in FIGS. 14-19, can accommodate this hole pattern via slots 44 (FIGS. 16 and 17) can also accommodate channel boards via apertures 38*e* (also FIGS. 16 and 17). A channel board includes two co-linear channels, one for each boot binding, that are positioned along the lengthwise centerline of the snowboard 34. The inventor envisions that apertures or slots in the disk 38 can be arranged to accommodate other mounting hole patterns; for example, a so-called "4×4" hole pattern or a snowboard mounting system sold by Burton Corporation under the registered trademark 3D® and BURTON 3D®.

Figure 3:
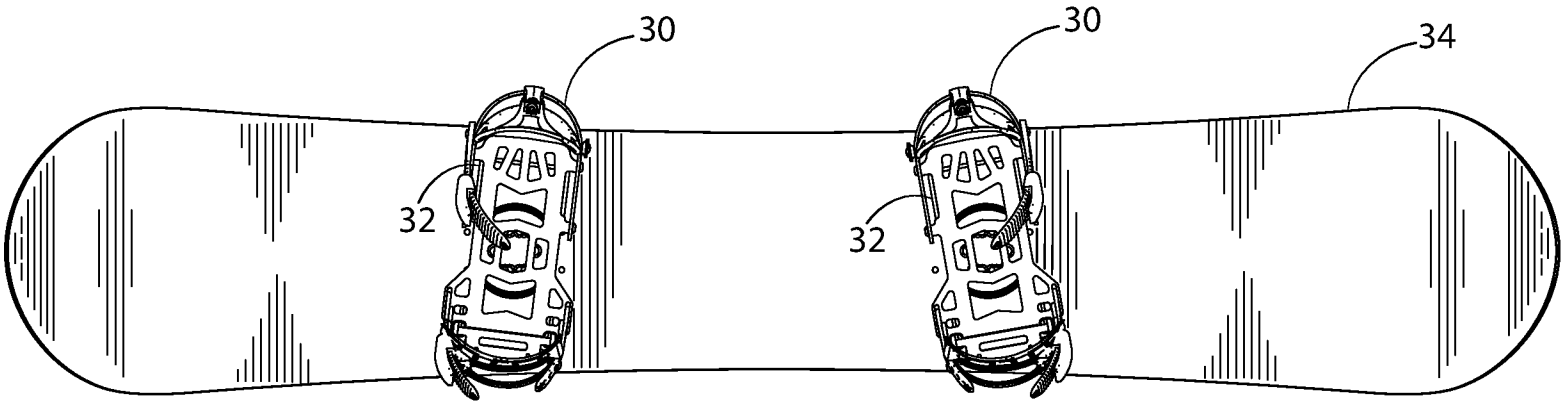
FIG. 3 illustrates, in top view, the snowboard, splitboard boot bindings, and the puck assembly with the boots mounted in a first position.
Figure 4:
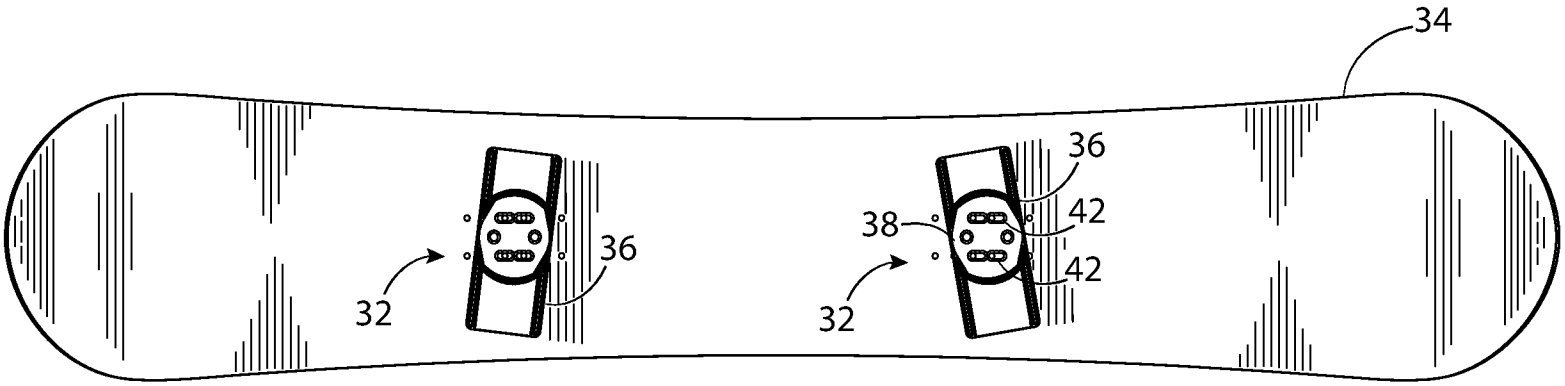
FIG. 4 illustrates, in top view, FIG. 3 with the splitboard boot bindings removed to show the position of the puck assembly relative to the snowboard.
Figure 5:
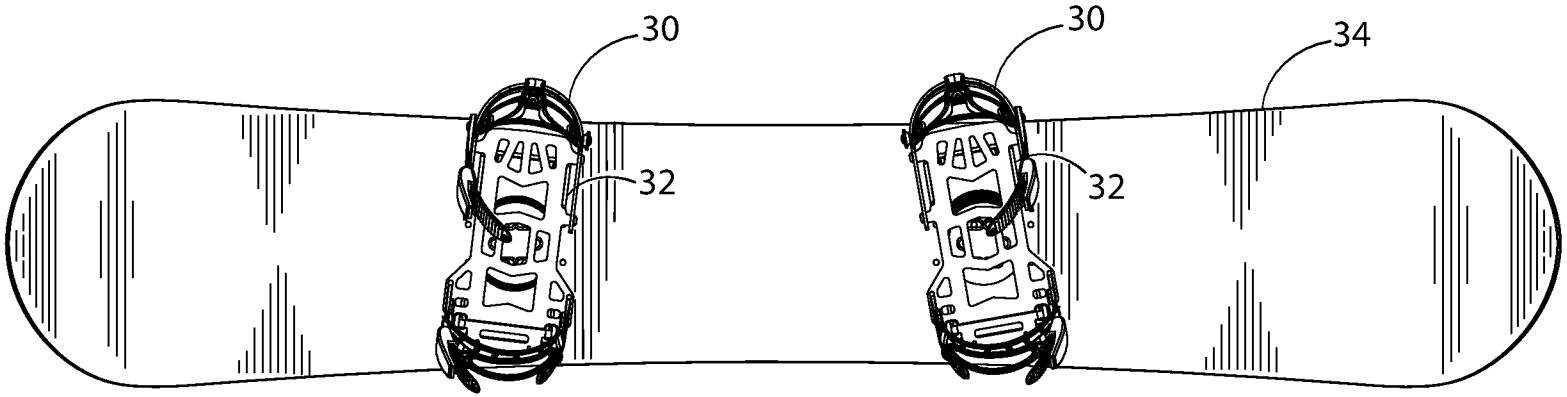
FIG. 5 illustrates, in top view, the snowboard, splitboard boot bindings, and the puck assembly with the boots mounted in a second position.
Figure 6:
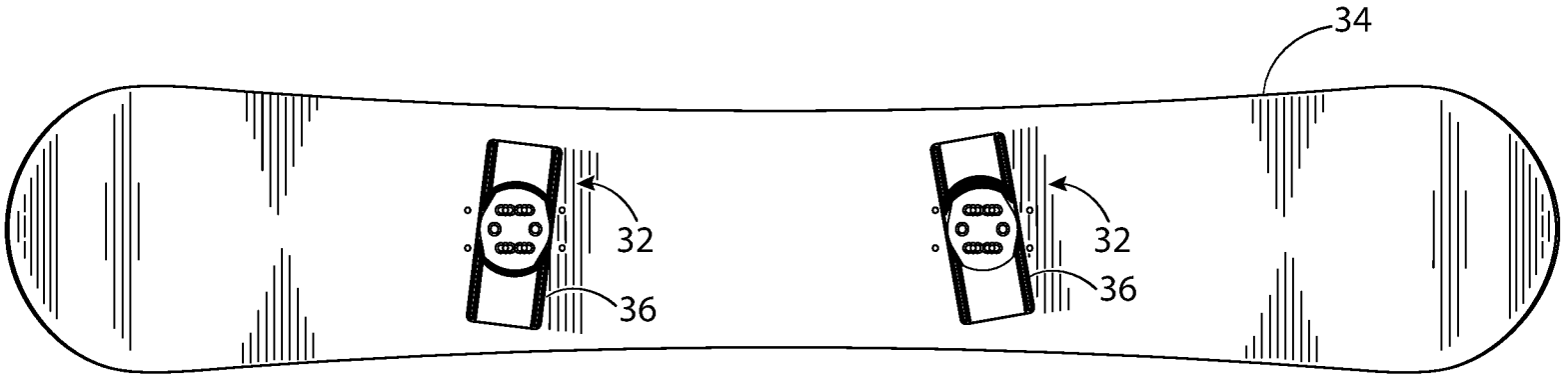
FIG. 6 illustrates, in top view, FIG. 5 with the splitboard boot bindings removed to show the position of the puck assembly relative to the snowboard.
Figure 7:
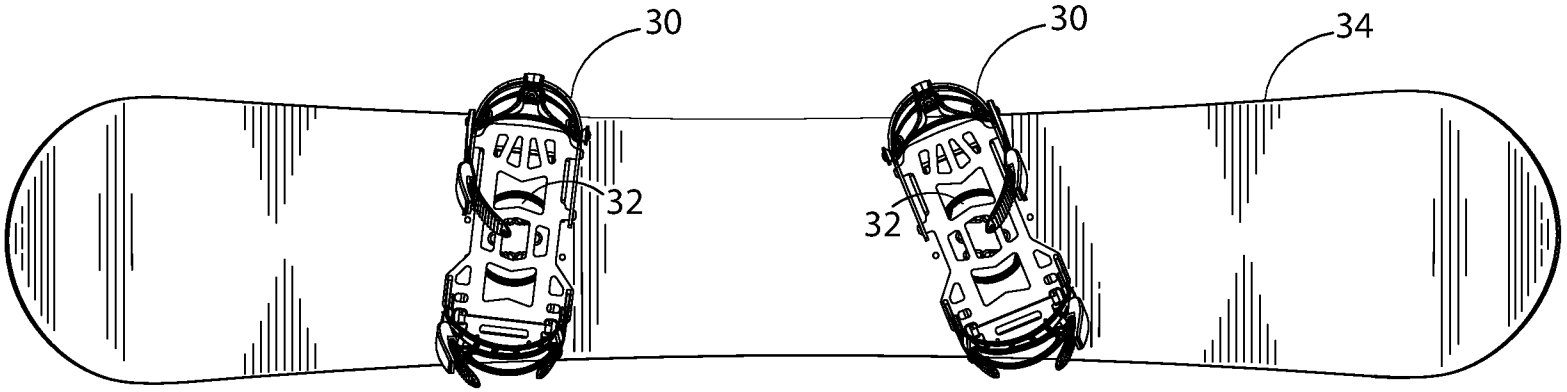
FIG. 7 illustrates, in top view, the snowboard, splitboard boot bindings, and the puck assembly with the boots mounted in a third position.
Figure 8:
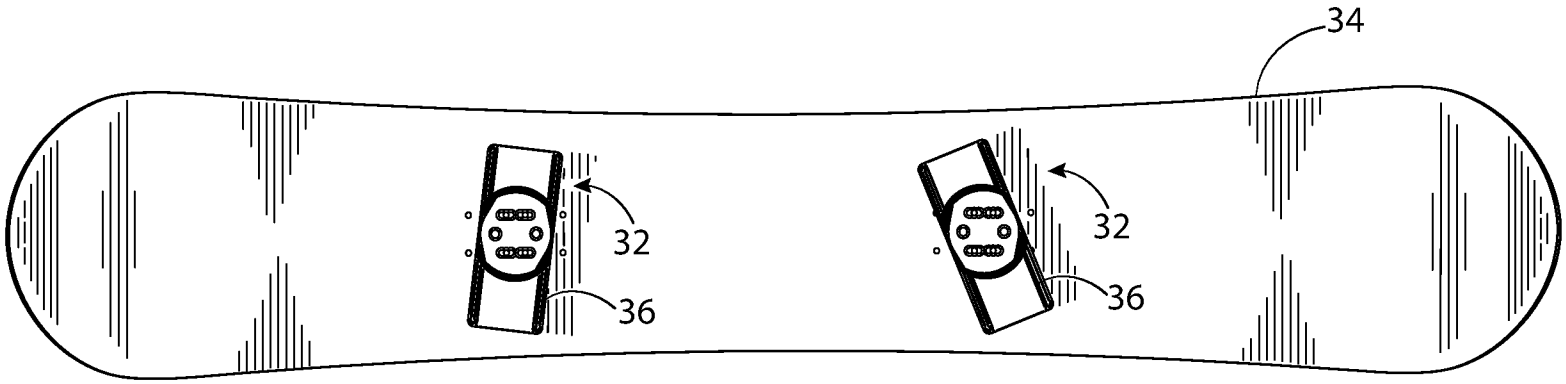
FIG. 8 illustrates, in top view, FIG. 7 with the splitboard boot bindings removed to show the position of the puck assembly relative to the snowboard.

FIGS. 3-8 illustrate how the puck assembly 32 can adjust the foot placement, foot angle, or toe centering. FIGS. 3, 5, and 7 illustrate, in top view, the snowboard 34, splitboard boot bindings 30 (or snowboard boot bindings with the base plate exploded away), and the puck assembly 32 (or base plate puck assembly in the case of a snowboard boot binding) with the splitboard boot bindings 30 (or snowboard boot bindings with the base plate exploded away) mounted in a first, second, third, and fourth position respectively. FIGS. 4, 6, and 8 illustrate, in top view, FIGS. 3, 5, and 7 respectively with the splitboard boot bindings 30 (or snowboard boot bindings with the base plate exploded away) removed to show the position and angle of the puck assembly 32 relative to the snowboard 34. Referring to FIG. 6, the slider block/snowboard binding base plate 36 on the front end of the snowboard 34 is moved toward the heel edge of the illustration as compared to the position of the corresponding slider block/snowboard binding base plate 36 in FIG. 4. This results in a corresponding movement of the splitboard boot binding 30 (or snowboard boot binding with the base plate exploded away) of FIG. 5. In FIG. 8, the slider block/snowboard binding base plate 36 on the right side of the illustration is rotated counter clockwise as compared with the corresponding movement of the slider block/snowboard binding base plate 36 of FIG. 4. This results in a corresponding movement of the splitboard boot binding 30 (or snowboard boot binding with the base plate exploded away) of FIG. 7.

Figure 9:
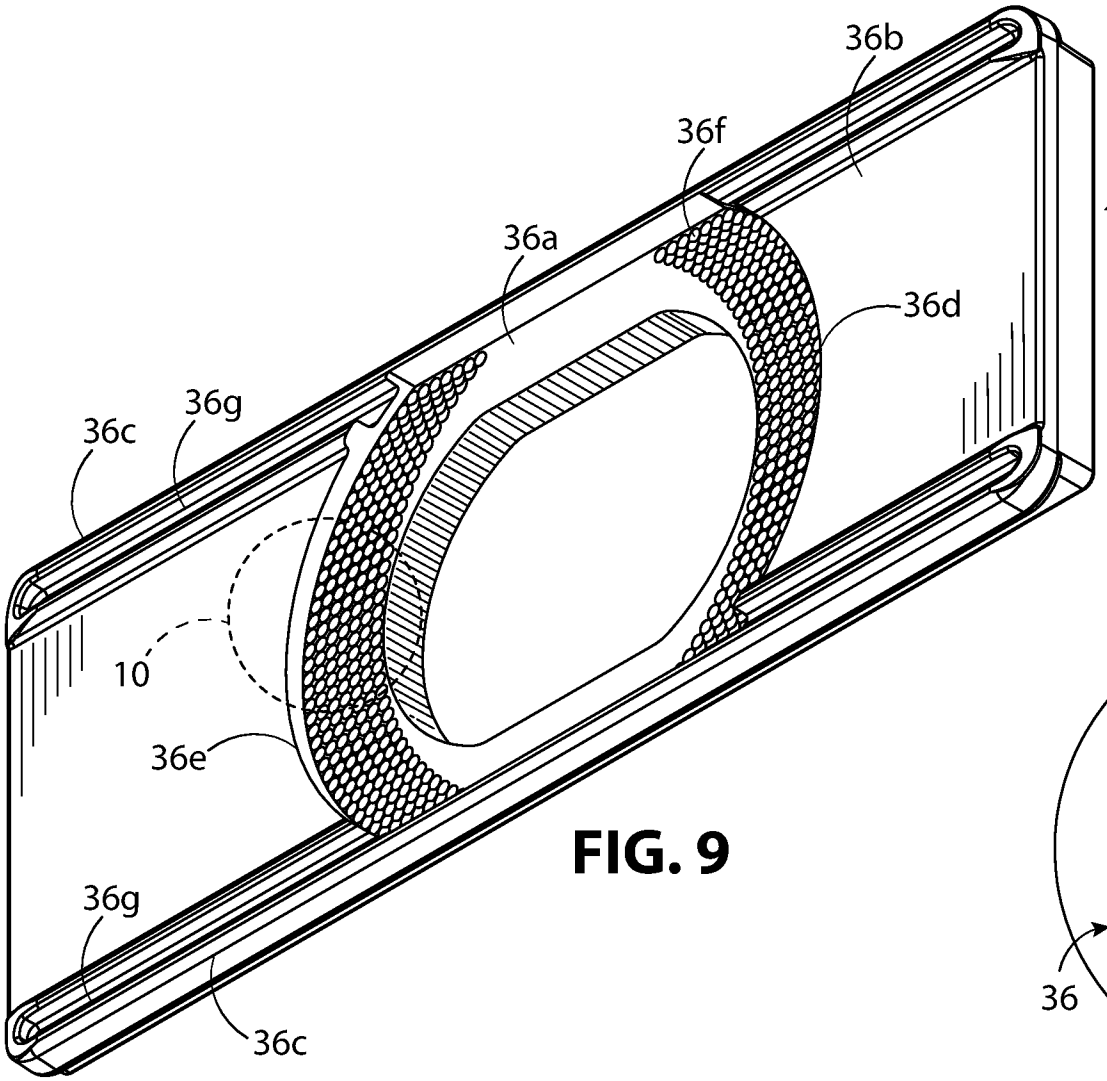
FIG. 9 illustrates, in top perspective view, the slider block or snowboard binding base plate.
Figure 10:
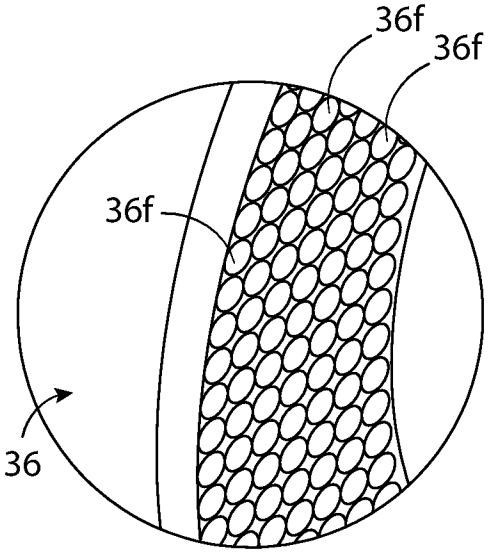
FIG. 10 illustrates an enlarged partial view of FIG. 9 showing the surface pattern in more detail.
Figure 11:
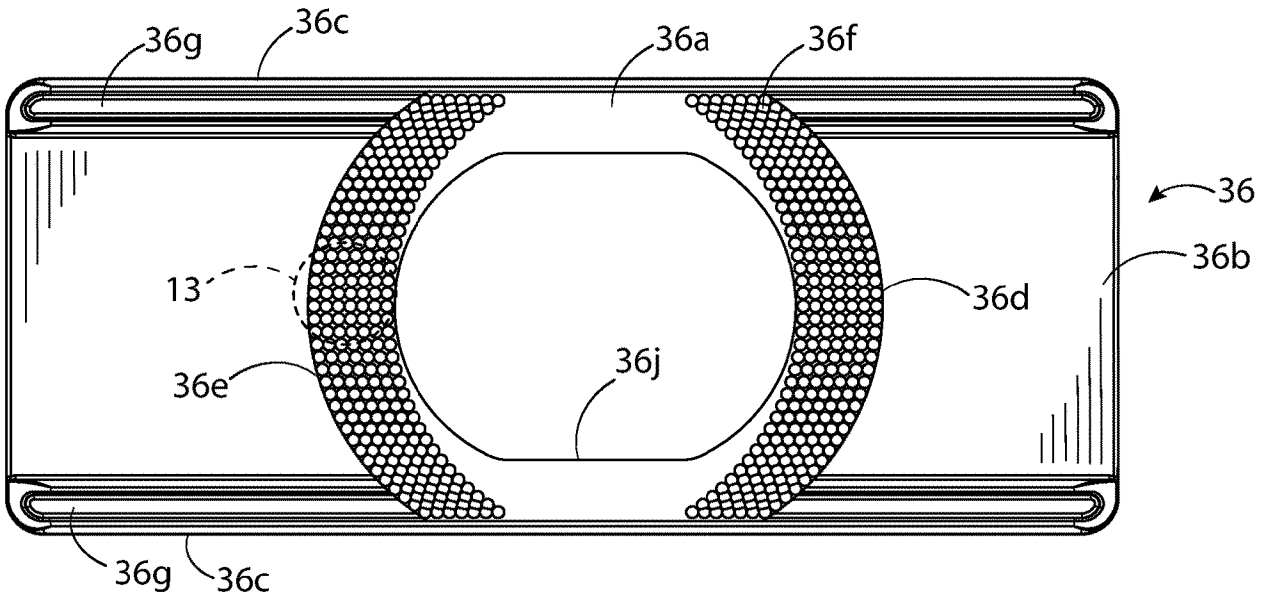
FIG. 11 illustrates, in top view, the slider block or snowboard binding base plate.
Figure 12:
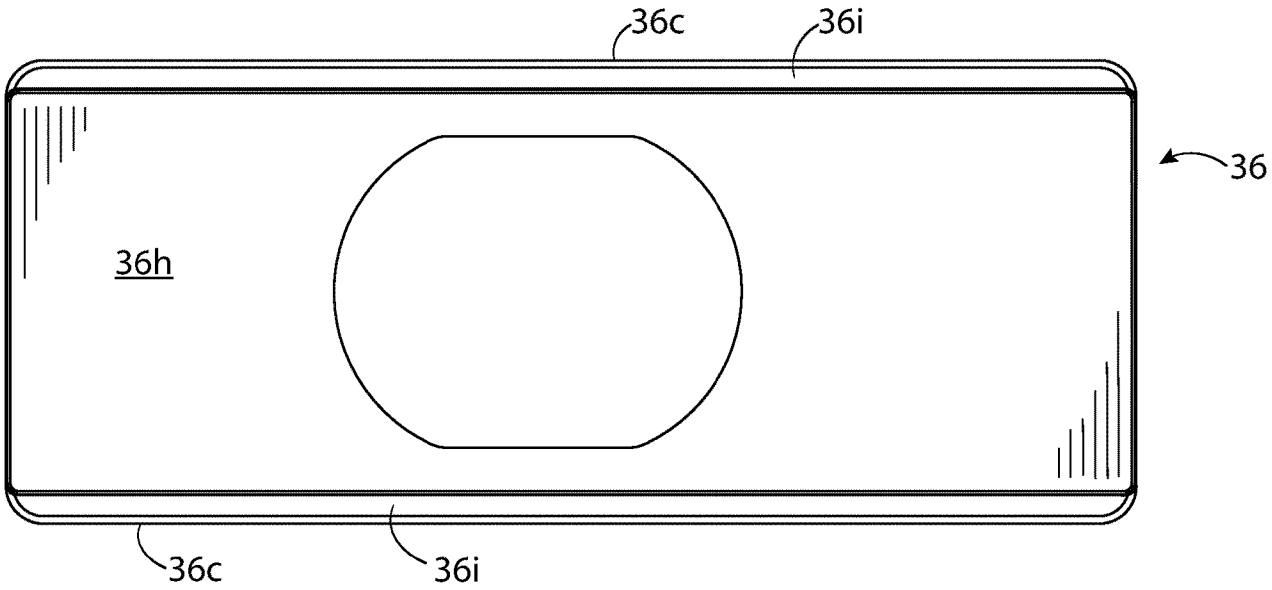
FIG. 12 illustrates, in bottom view, the slider block or snowboard binding base plate.
Figure 14:
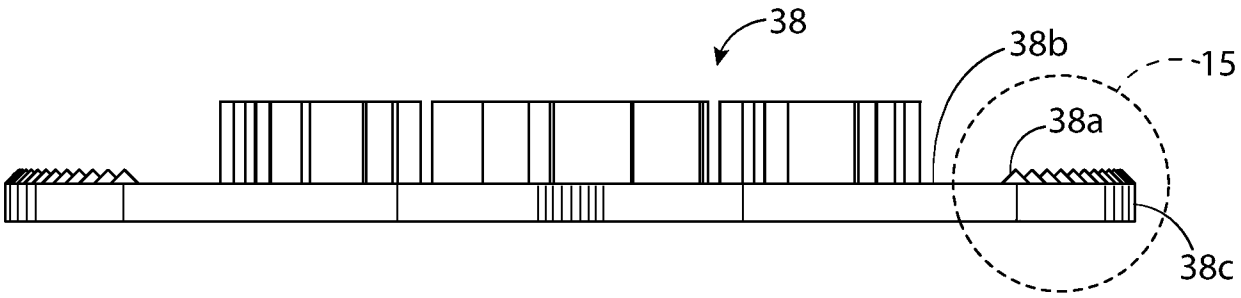
FIG. 14 illustrates, a side view of the disk.
Figure 15:
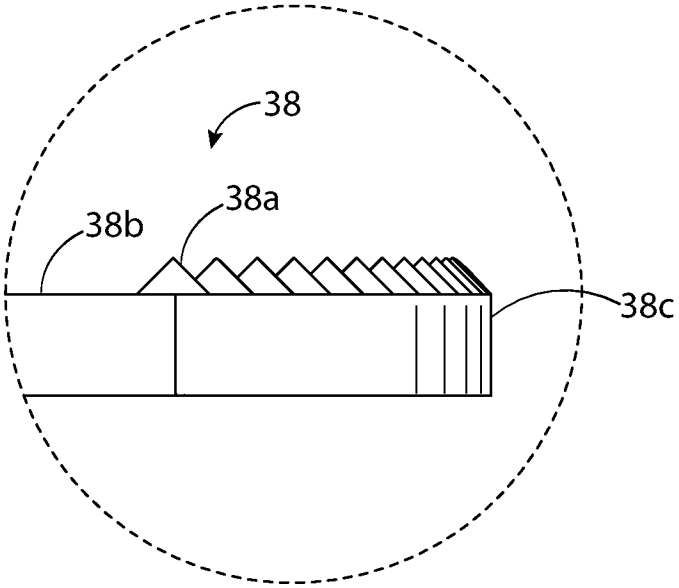
FIG. 15 illustrates an enlarged partial view of FIG. 14 illustrating the side profile of the projections in more detail.
Figure 13:
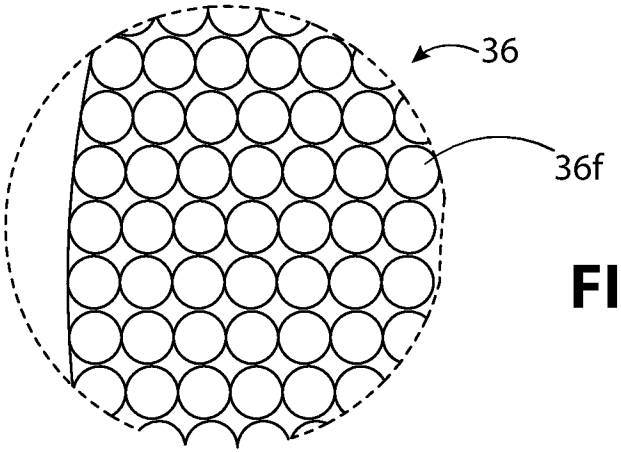
FIG. 13 illustrates, an enlarged partial view of FIG. 11 showing a top view of the detents in the surface of the slider block or snowboard binding base plate.
Figure 16:
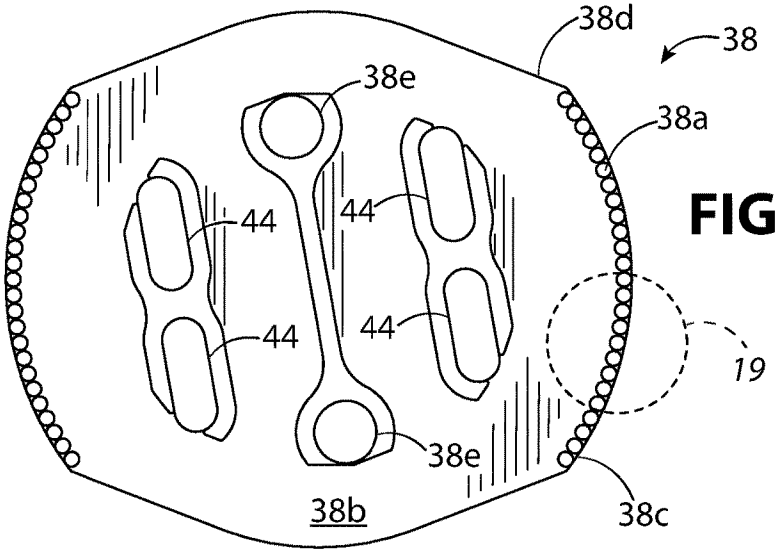
FIG. 16 illustrates, in bottom view, the disk.
Figure 17:
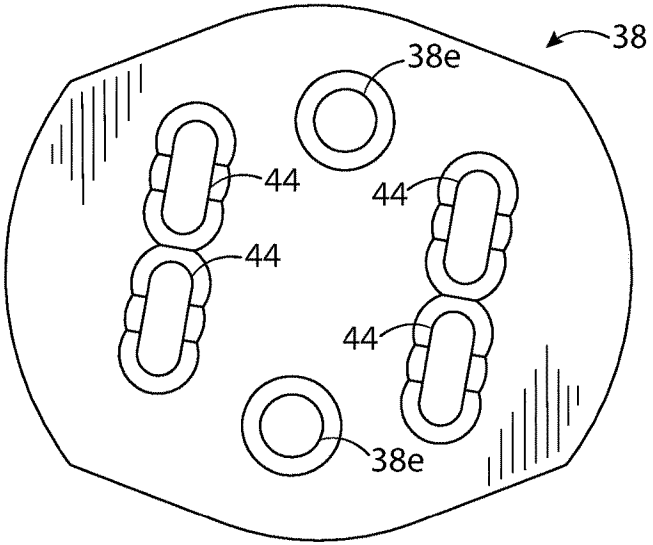
FIG. 17 illustrates a top view of the disk.
Figure 18:
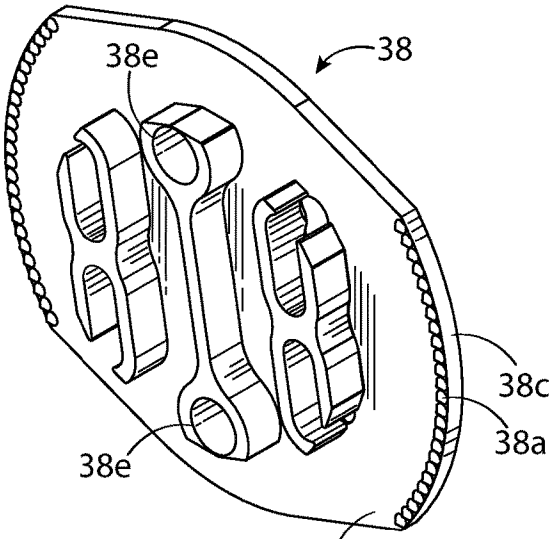
FIG. 18 illustrates the disk, in bottom perspective view.
Figure 19:
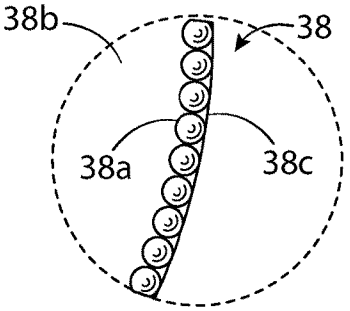
FIG. 19 illustrates an enlarged detail view of the disk of FIG. 16.

FIGS. 9-13 illustrate the slider block/snowboard binding base plate 36. FIGS. 14-19 illustrate the disk 38 in more detail. FIG. 9 illustrates, in top perspective view, the slider block/snowboard binding base plate 36. FIG. 10 illustrates an enlarged partial view of FIG. 9 showing the surface pattern of the recessed surface 36*a* in the slider block/snowboard binding base plate 36. FIG. 11 illustrates, in top view, the slider block/snowboard binding base plate 36. FIG. 12 illustrates, in bottom view, the slider block/snowboard binding base plate 36. FIG. 13 illustrates, an enlarged partial view of FIG. 11 showing a top view of the detents 36*f* in the surface of the slider block/snowboard binding base plate 36. FIG. 14 illustrates, a side view of the disk 38. The detents 36*f* are illustrated forming enclosed circular cross-sectional shapes in the surface of the slider block/snowboard binding base plate 36. The detents 36*f* can form other enclosed cross-sectional shapes. For example, ellipses or polygons. FIG. 15 illustrates an enlarged partial view of the disk 38 illustrating the side profile of the projections 38*a* in more detail. FIG. 16 illustrates, in bottom view, the disk 38. FIG. 17 illustrates a top view of the disk 38. FIG. 18 illustrates the disk 38, in bottom perspective view. FIG. 19 illustrates an enlarged detail view of the disk 38 from FIG. 16.

Referring to FIGS. 9 and 11, the slider block/snowboard binding base plate 36 includes a recessed surface 36*a* that is recessed from the top surface 36*b* of the slider block/snowboard binding base plate 36. The top surface 36*b* includes a substantially planar portion surrounding the recessed surface 36*a* lengthwise of both sides. The lengthwise edges 36*c* of the top surface 36*b* are grooved 36*g*. Referring to FIG. 12 the corresponding edges on the bottom surface 36*h* are inset along both of the lengthwise edges 36*c*. The inset 36*i* is sized to allow the slider block/snowboard binding base plate 36 to slidably receive the bottom of the splitboard boot binding. Referring to FIGS. 9 and 11, the recessed surface 36*a* is bound by perimeter edges 36*d*, 36*e* on lengthwise opposite sides of the recessed surface. These perimeter edges 36*d*, 36*e* can be shaped like circular segments as illustrated. The remainder of the recessed surface 36*a* can be bound by the lengthwise edges 36*c* of the slider block/snowboard binding base plate 36. The centers of the perimeter edges 36*d*, 36*e* can be separated by a distance equal to the toe and heel centering range. The slider block/snowboard binding base plate 36 is patterned with detents 36*f* or blind holes. These detents 36*f* are arranged as circular arcs of equal radius.

Referring to FIGS. 9-11 and 13, besides being arranged in circular arcs, the detents 36*f* can be spaced as a series of arcs, of equal radius, and optionally be translated linearly on even increments. The detents 36*f* could alternatively be translated in uneven increments or an arbitrary distance depending on design criteria. The combination of radial and linear alignment of the detents 36*f* allows for the foot angle and heel and toe centering adjustments to be made concurrently. In FIGS. 10 and 13, the detents 36*f* are shown as optionally being arranged nearly edge-to-edge.

Referring to FIGS. 14-16, 18, and 19, the disk 38 includes projections 38*a* projecting out of the bottom surface 38*b*. The projections 38*a* can be arranged as a circular arc with a radius equal to the radii of the circular arcs of the detents 36*f* of FIGS. 9 and 11. The projections 38*a* can optionally be arranged concentrically about the center of the disk 38. The projections are complementary in size and shape with the detents 36*f* of FIGS. 9 and 11. For example, in FIG. 15, the projection 38*a* is a conical projection. The detent 36*f* of FIGS. 9 and 11 would then be a conical detent of corresponding size and shape. The detent 36*f* of FIGS. 9 and 11 and the projections 38*a* take other complementary shapes for example, a frusto-conical detent with a corresponding frusto-conical projection. Other shapes can include, a portion of a sphere, elliptical solid, or parabolic solid. Referring to FIGS. 16-18, disk 38 also includes apertures 38*e* sized and spaced for mounting to channel style snowboards.

The angular spacing between the projections 38*a* must be a whole number multiple of the angular spacing between adjacent detents of the detents 36*f* of FIGS. 9 and 11. For example, the detents 36*f* could have an angular spacing of 3° while the projections have an angular spacing that is some whole number multiple such as 3°, 6°, 9°, or a combination of those intervals. These angles are examples and are not meant to be limiting. Other angles and combinations are possible. There can be fewer of the projections 38*a* than illustrated in FIGS. 16, 18, and 19. The radius of the circular arc of the projections 38*a* must be the same radius as the circular arc of the detents 36*f*. Referring to FIGS. 14-16, 18, and 19, the projections 38*a* are arranged in a single row along the outside perimeter edge 38*c*. While arranging the projections 38*a* along the perimeter edge maximizes the adhesion between the disk 38 and the recessed surface 36*a*, placing the projections along the perimeter edge is not critical.

Referring to FIG. 4, the disk 38 is fastened to the surface of the snowboard 34 by threaded fasteners 42. Referring to FIGS. 4 and 17, the threaded fasteners 42 (FIG. 4) project through slots 44 in the disk 38 (FIG. 17). Referring to FIGS. 4, 11, and 17, the threaded fasteners 42 (FIG. 4) project from the disk 38 (FIG. 17) through an aperture 36*j* (FIG. 11) in the slider block/snowboard binding base plate 36. The aperture 36*j* (FIG. 11) is sized so the slots 44 (FIG. 17) remain unimpeded no matter how the disk 38 (FIG. 17) is rotated. The aperture 36*j* is also sized so the disk 38 is unimpeded with a heel and toe centering adjustment. The slots 44, which have three scalloped locations for the mounting screws, along with the inserts used in the snowboard 34 of FIG. 4, allow for the foot placement degree of freedom. Referring to FIG. 4, the angle of the slider block/snowboard binding base plate 36 is positioned by loosening the threaded fasteners 42 and moving the slider block/snowboard binding base plate 36 relative to the disk 38. Referring to FIGS. 11 and 16, the arrangement of detents 36*f* (FIG. 11) and corresponding arrangement of projections 38*a* (FIG. 16), allow adjustment with two degrees of freedom. The slots 44 (FIG. 16) allow for a third degree of freedom. Referring to FIG. 16, the angle of rotation can be limited by the linear cut surfaces 38*d* in the disk 38. Referring to FIGS. 11 and 16, the disk 38 (FIG. 16) is stopped from rotating by the linear cut surfaces 38*d* (FIG. 16) stop against the lengthwise edges 36*c* within the recess. The threaded fasteners 42 (FIG. 4) can also go through other holes in the disk 38 (FIG. 4) meant for channel style boards.

This disclosure describes a puck assembly for snowboard and other snow glide boards. This disclosure does not intend to limit the claimed invention to the examples, variations, and exemplary embodiments described in the specification. Those skilled in the art will recognize that variations will occur when embodying the claimed invention in specific implementations and environments. For example, the novel patterned surface and projection combination can be applied as snowboard binding puck, and directly the base plate of a snowboard binding as discussed. It can also be applied to splitboard binding pucks.

Figure 20:
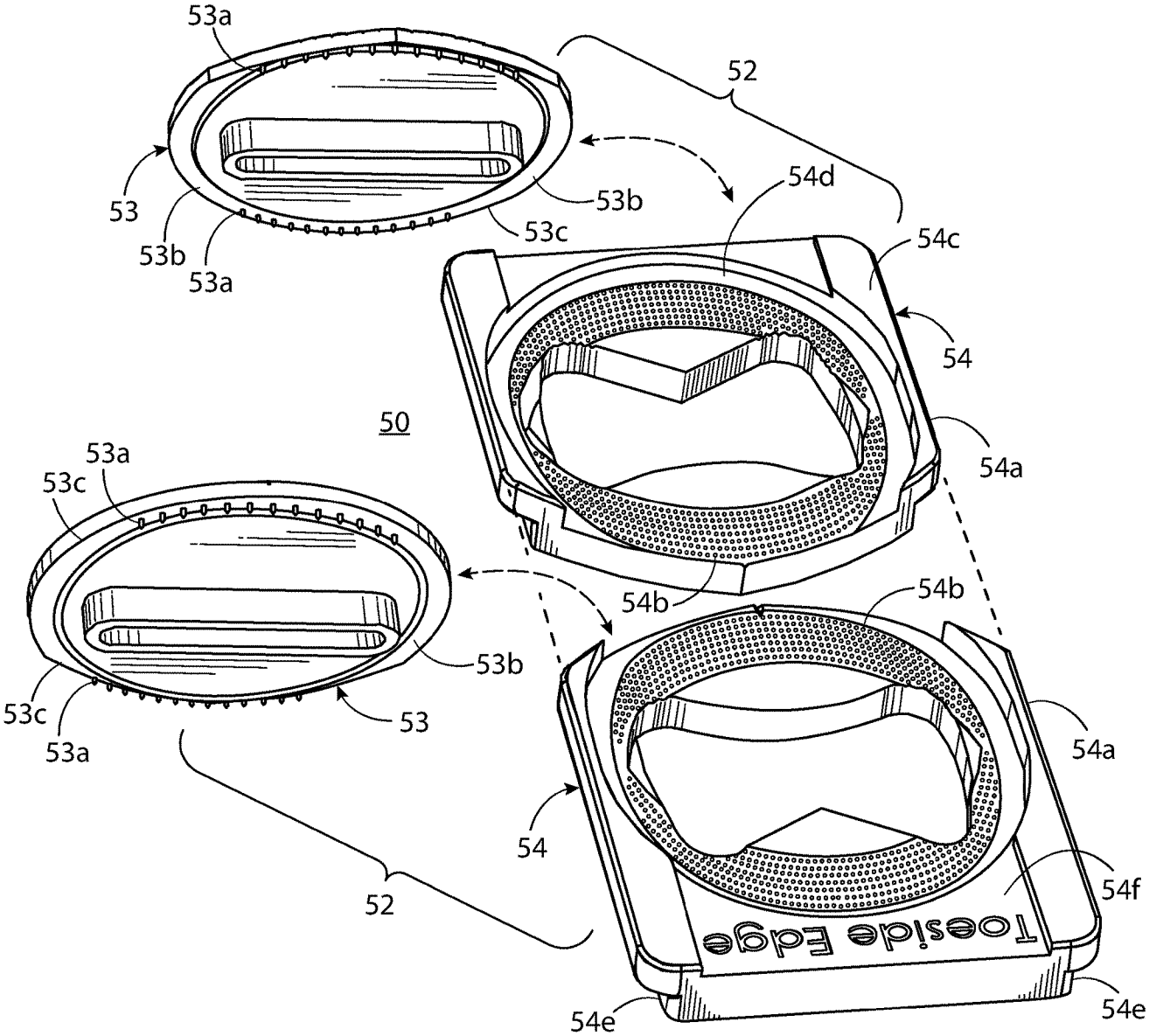
FIG. 20 illustrates a splitboard puck assembly in exploded perspective view.
Figure 21:
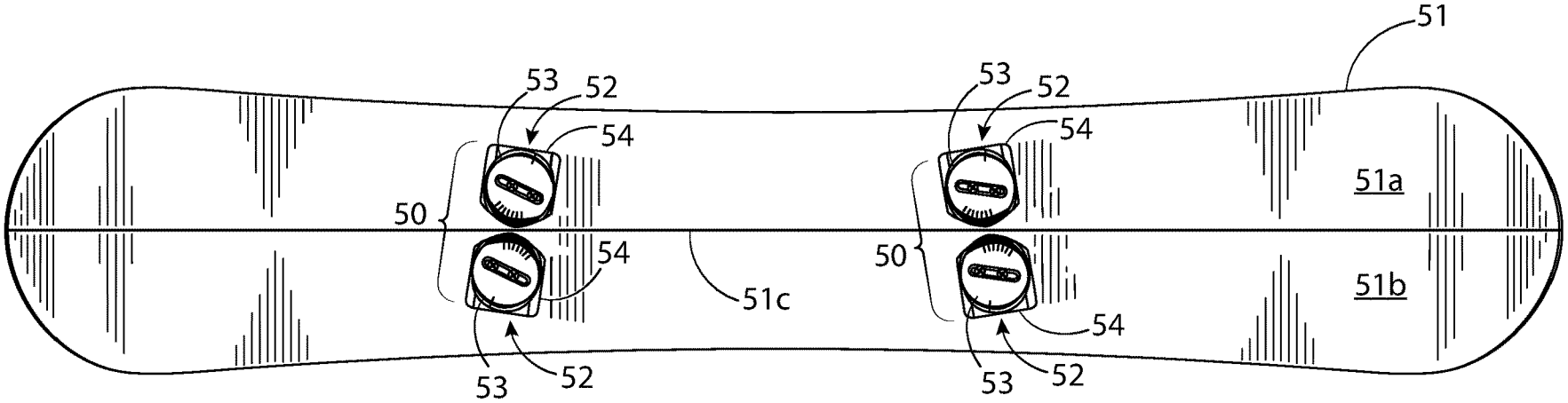
FIG. 21 illustrates a splitboard with a pair of splitboard puck assemblies.

FIGS. 20 and 21 illustrate an example of a splitboard puck assembly 50 for use with a splitboard. FIG. 20 illustrates the splitboard puck assembly 50 in exploded perspective view. FIG. 21 illustrates a pair of splitboard puck assemblies 50 mounted on a splitboard 51. Referring to FIGS. 20 and 21, each splitboard puck assembly 50 includes a pair of splitboard puck subassemblies 52. Each splitboard puck subassembly 52 includes a disk 53 and a splitboard puck 54. Referring to FIG. 21, a splitboard 51 is typically divided into a first splitboard ski 51*a* and a second splitboard ski 51*b* that are joined together along a lengthwise edge 51*c* that can run down the center of the splitboard from the tip to the tail of the board. Each splitboard puck assembly 50 is mounted across the lengthwise edge 51*c* with one of the splitboard puck subassemblies 52 mounted to the first splitboard half 51*a* and the second of the splitboard puck subassemblies 52 mounted to the second splitboard half 51*b*. Referring to FIG. 20, the tips of the slider blocks face each other with the outside lengthwise edges 54*a* of the splitboard puck 54 linearly aligned. This allows the puck assembly to act as a unit with and allows the boot binding base plate to slide along both the splitboard puck subassemblies 52.

The novel patterned surface described for the slider block/snowboard binding base plate 36 of FIGS. 9 and 11 and the disk 38 of FIGS. 14-19 can be applied in a similar way to the splitboard puck 54 and the disk 53 of FIGS. 20 and 21. Referring to FIG. 20, the splitboard puck 54 is patterned with detents 54*b* or blind holes. The detents 54*b* are illustrated forming enclosed circular cross-sectional shapes in the surface of the splitboard puck 54. The detents 54*b* can form other enclosed cross-sectional shapes. For example, ellipses or polygons. These detents 54*b* can be arranged as circular arcs of equal radius. The detents 54*b* can be spaced as a series of arcs, of equal radius, and optionally be translated linearly on even increments. The detents 54*b* could alternatively be translated in uneven increments or an arbitrary distance depending on design criteria. The combination of radial and linear alignment of the detents 54*b* allows for the foot angle and heel and toe centering adjustments to be made concurrently. The detents can optionally be arranged nearly edge-to-edge.

The disk 53 includes projections 53*a* projecting out of the bottom surface 53*b* of the disk 53. The projections 53*a* can be arranged as a circular arc with a radius equal to the radii of the circular arcs of the detents 54*b*. The projections 53*a* can optionally be arranged concentrically about the center of the disk 53. The projections can be complementary in size and shape with the detents 36*f*. For example, if the projection 53*a* is a conical projection, the detent 54*b* would then be a conical detent of corresponding size and shape. If the projection 53*a* were frusto-conical, then the detent 54*b* would be a frusto-conical of corresponding size and shape. If the detent were a portion of a sphere, portion of an elliptical solid, or a portion of a parabolic solid, then the detent would be a portion of a sphere, portion of an elliptical solid, or a portion of a parabolic solid, respectively, of corresponding shape and size.

The angular spacing between the projections 53*a* must be a whole number multiple of the angular spacing between the detents 54*b*. For example, the detents 36*f* could have an angular spacing of an angular spacing of 3° while the projections have an angular spacing that is some whole number multiple such as 3°, 6°, 9°, or a combination of those intervals. These angles are examples and are not meant to be limiting. Other angles and combinations are possible. There can be fewer or more of the projections 53*a* than illustrated. The radius of the circular arc of the projections 53*a* must be the same radius as the circular arc of the detents 54*b*. The projections are arranged in a single row proximate to the outside perimeter edge 53*c* of the disk 53. While arranging the projections 53*a* along the outside perimeter edge 53*c* maximizes the adhesion between the disk 53 and the projections 53*a*, placing the projections along the perimeter edge is not critical.

The splitboard puck 54 includes the splitboard puck includes a top surface 54*c* and a recessed surface 54*d* recessed in the top surface. The detents 54*b* are disposed in the recessed surface 54*d*. The recessed surface 54*d* is sized and shaped to accept the disk 53 within the recessed surface 54*d*. The top surface includes a substantially planar portion surrounding the recessed surface lengthwise of both sides. The top surface 54*c* can be sized and shaped to slidably receive the bottom of the splitboard boot binding. This can be facilitated by an inset 54*e* along the bottom lengthwise edges of the splitboard puck 54 and an inset 54*f* in the top surface 54*c*.

While the examples and variations are helpful to those skilled in the art in understanding the claimed invention is defined by the claims and their equivalents.

Any appended claims are not to be interpreted as including means-plus-function limitations, unless a claim explicitly evokes the means-plus-function clause of 35 USC § 112(f) by using the phrase "means for" followed by a verb in gerund form.

"Optional" or "optionally" is used throughout this disclosure to describe features or structures that are optional. Not using the word optional or optionally to describe a feature or structure does not imply that the feature or structure is essential, necessary, or not optional. Using the word "or," as used in this disclosure is to be interpreted as the ordinary meaning of the word "or" (i.e., an inclusive or) For example, the phrase "A or B" can mean: (1) A, (2) B, (3) A with B.

Throughout this disclosure, the term, "puck assembly" and the more general term "mounting device" are used interchangeably. In the context of this disclosure, a puck assembly can be a separate assembly that mounts to a snowboard with the boot bindings attaching to the assembly or it can be an assembly that forms part of the snowboard boot binding.

Here are some additional examples:

EXAMPLE 1

A mounting device for a snowboard boot binding, comprising: a snowboard binding base plate; a disk; the snowboard binding base plate includes a plurality of detents aligned in a series of arcs of equal radius and spaced linearly along a length of the snowboard binding base plate; and the disk includes a plurality of projections, the plurality of projections follows an arc of equal radius to the series of arcs.

EXAMPLE 2

The mounting device of Example 1, wherein the series of arcs are circular arcs.

EXAMPLE 3

The mounting device of Example 2, wherein projections of the plurality of projections and detents of the plurality of detents are complementary shaped.

EXAMPLE 4

The mounting device of Example 1, wherein projections of the plurality of projections and detents of the plurality of detents are complementary shaped.

EXAMPLE 5

The mounting device of Example 1, wherein: the snowboard binding base plate includes a top surface and a recessed surface recessed in the top surface; and the recessed surface is sized and shaped to accept the disk within the recessed surface.

EXAMPLE 6

The mounting device of Example 5, wherein the series of arcs are circular arcs.

EXAMPLE 7

The mounting device of Example 6, wherein projections of the plurality of projections and detents of the plurality of detents are complementary shaped.

EXAMPLE 8

The mounting device of Example 5, wherein projections of the plurality of projections and detents of the plurality of detents are complementary shaped.

EXAMPLE 9

A mounting device that mounts to a snowboard, comprising: a slider block; a disk; the slider block includes a plurality of detents aligned in a series of arcs of equal radius and spaced linearly along a length of the slider block; and the disk includes a plurality of projections, the plurality of projections follow an arc of equal radius to the series of arcs.

EXAMPLE 10

The mounting device of Example 9, wherein the series of arcs are circular arcs.

EXAMPLE 11

The mounting device of Example 10, wherein projections of the plurality of projections and detents of the plurality of detents are complementary shaped.

EXAMPLE 12

The mounting device of Example 9, wherein projections of the plurality of projections and detents of the plurality of detents are complementary shaped.

EXAMPLE 13

The mounting device of Example 9, wherein: the slider block includes a top surface and a recessed surface recessed in the top surface; and the recessed surface is sized and shaped to accept the disk within the recessed surface.

EXAMPLE 14

The mounting device of Example 13, wherein the series of arcs are circular arcs.

EXAMPLE 15

The mounting device of Example 14, wherein projections of the plurality of projections and detents of the plurality of detents are complementary shaped.

EXAMPLE 16

The mounting device of Example 13, wherein projections of the plurality of projections and detents of the plurality of detents are complementary shaped.

EXAMPLE 17

A mounting device for a snowboard boot binding, comprising: a snowboard binding base plate; a disk; the snowboard binding base plate includes a plurality of detents, the plurality of detents are arranged as a series of arcs, of equal radius, translated linearly on even increments; and the disk includes a plurality of projections, the plurality of projections follow an arc of equal radius to the series of arcs.

EXAMPLE 18

The mounting device of Example 17, wherein the series of arcs are circular arcs.

EXAMPLE 19

The mounting device of Example 18, wherein projections of the plurality of projections and detents of the plurality of detents are complementary shaped.

EXAMPLE 20

The mounting device of Example 17, wherein projections of the plurality of projections and detents of the plurality of detents are complementary shaped.

EXAMPLE 21

The mounting device of Example 17, wherein: the snowboard binding base plate includes a top surface and a recessed surface recessed in the top surface; and the recessed surface is sized and shaped to accept the disk within the recessed surface.

EXAMPLE 22

The mounting device of Example 21, wherein the series of arcs are circular arcs.

EXAMPLE 23

The mounting device of Example 22, wherein projections of the plurality of projections and detents of the plurality of detents are complementary shaped.

EXAMPLE 24

The mounting device of Example 21, wherein projections of the plurality of projections and detents of the plurality of detents are complementary shaped.

EXAMPLE 25

A mounting device that mounts to a snowboard, comprising: a slider block; a disk; the slider block includes a plurality of detents, the plurality of detents are arranged as a series of arcs, of equal radius, translated linearly on even increments; and the disk includes a plurality of projections, the plurality of projections follow an arc of equal radius to the series of arcs.

EXAMPLE 26

The mounting device of Example 25, wherein the series of arcs are circular arcs.

EXAMPLE 27

The mounting device of Example 26, wherein projections of the plurality of projections and detents of the plurality of detents are complementary shaped.

EXAMPLE 28

The mounting device of Example 25, wherein projections of the plurality of projections and detents of the plurality of detents are complementary shaped.

EXAMPLE 29

The mounting device of Example 25, wherein: the slider block includes a top surface and a recessed surface recessed in the top surface; and the recessed surface is sized and shaped to accept the disk within the recessed surface.

EXAMPLE 30

The mounting device of Example 29, wherein the series of arcs are circular arcs.

Example 31

The mounting device of Example 30, wherein projections of the plurality of projections and detents of the plurality of detents are complementary shaped.

EXAMPLE 32

The mounting device of Example 29, wherein projections of the plurality of projections and detents of the plurality of detents are complementary shaped.

EXAMPLE 33

The mounting device of Example 1, wherein the angular spacing between adjacent projections of the plurality of projections is a whole number multiple of the angular spacing between adjacent detents of the plurality of detents.

EXAMPLE 34

The mounting device of Example 9, wherein the angular spacing between adjacent projections of the plurality of projections is a whole number multiple of the angular spacing between adjacent detents of the plurality of detents.

EXAMPLE 34

The mounting device of Example 17, wherein the angular spacing between adjacent projections of the plurality of projections is a whole number multiple of the angular spacing between adjacent detents of the plurality of detents.

EXAMPLE 35

The mounting device of Example 25, wherein the angular spacing between adjacent projections of the plurality of projections is a whole number multiple of the angular spacing between adjacent detents of the plurality of detents.

What is claimed is:

1. A puck assembly for a snowboard boot binding, comprising:

a snowboard binding base plate;

a disk;

the snowboard binding base plate includes a plurality of detent series, each detent series of the plurality of detent series includes a plurality of enclosed detents spaced apart and arranged along an arc, each detent series are of equal radius and spaced linearly along a length of the snowboard binding base plate; and the disk includes a plurality of projections, the plurality of projections follows a second arc of equal radius to the arc of each detent series.

2. The puck assembly of claim 1, wherein angular spacing between adjacent projections of the plurality of projections is a whole number multiple of angular spacing between adjacent enclosed detents of each detent series.

3. The puck assembly of claim 2, wherein each projection of the plurality of projections and each enclosed detent of the plurality of enclosed detents are complementary shaped.

4. The puck assembly of claim 1, wherein projections of the plurality of projections and enclosed detents of the plurality of enclosed detents are complementary shaped.

5. The puck assembly of claim 1, wherein each detent series is shaped as a circular arc.

6. The puck assembly of claim 1, wherein:

the plurality of enclosed detents and projections are aligned and shaped to allow the projections to engage the disk to engage the snowboard binding base plate with three-degrees of freedom.

7. A puck assembly that mounts to a snowboard, comprising:

a slider block;

a disk;

the slider block includes a plurality of detent series, each detent series of the plurality of detent series includes a plurality of enclosed detents spaced apart and arranged along an arc, each detent series are of equal radius and spaced linearly along a length of the slider block; and the disk includes a plurality of projections, the plurality of projections follows a second arc of equal radius to the arc of each detent series.

8. The puck assembly of claim 7, wherein angular spacing between adjacent projections of the plurality of projections is a whole number multiple of angular spacing between adjacent enclosed detents of each detent series.

9. The puck assembly of claim 8, wherein each projection of the plurality of projections and each enclosed detent of the plurality of enclosed detents are complementary shaped.

10. The puck assembly of claim 7, wherein projections of the plurality of projections and enclosed detents of the plurality of enclosed detents are complementary shaped.

11. The puck assembly of claim 7, wherein each detent series is shaped as a circular arc.

12. The puck assembly of claim 11, wherein projections of the plurality of projections and enclosed detents of the plurality of enclosed detents are complementary shaped.

13. The puck assembly of claim 7, wherein:

the plurality of enclosed detents and projections are aligned and shaped to allow the projections to engage the disk to engage the slider block with three-degrees of freedom.

14. A device that mounts to a splitboard, comprising:

a splitboard puck subassembly comprising a splitboard puck and a disk;

the splitboard puck includes a plurality of detent series, each detent series of the plurality of detent series includes a plurality of enclosed detents spaced apart and arranged along an arc, each detent series are of equal radius and spaced linearly along a length of the splitboard puck; and the disk includes a plurality of projections, the plurality of projections follows a second arc of equal radius to the arc of each detent series.

15. The device of claim 14, wherein angular spacing between adjacent projections of the plurality of projections is a whole number multiple of angular spacing between adjacent enclosed detents of each detent series.

16. The device of claim 15, wherein projections of the plurality of projections and each enclosed detent of the plurality of enclosed detents are complementary shaped.

17. The device of claim 14, wherein:

the plurality of enclosed detents and projections are aligned and shaped to allow the projections to engage the disk to engage the splitboard puck with three-degrees of freedom.

18. The device of claim 14, wherein projections of the plurality of projections and enclosed detents of the plurality of enclosed detents are complementary shaped.

19. The device of claim 14, wherein each detent series is shaped as a circular arc.

20. The device of claim 19, wherein projections of the plurality of projections and enclosed detents of the plurality of enclosed detents are complementary shaped.

* * * * *